United States Patent [19]

Stopforth

[11] Patent Number: 5,004,413

[45] Date of Patent: Apr. 2, 1991

[54] TABLET MAKING MACHINES

[75] Inventor: Douglas R. Stopforth, Aigburth, England

[73] Assignee: Manesty Machines Limited, Liverpool, England

[21] Appl. No.: 397,104

[22] Filed: Aug. 22, 1989

[30] Foreign Application Priority Data

Dec. 3, 1988 [DE] Fed. Rep. of Germany ..... 8815075

[51] Int. Cl.[5] ..... B30B 11/08

[52] U.S. Cl. ..... 425/182; 425/186; 425/193; 425/345

[58] Field of Search ..... 425/182, 185, 186, 193, 425/352-355, 406, 344, 345

[56] References Cited

U.S. PATENT DOCUMENTS

| | | | |
|---|---|---|---|
| 3,677,673 | 7/1972 | Shapiro | 425/193 |
| 3,825,387 | 7/1974 | Gilman | 425/182 |
| 3,891,375 | 6/1975 | Pilewski et al. | 425/354 |
| 4.057,381 | 11/1977 | Korsch | 425/352 |
| 4,362,491 | 12/1982 | Livingstone | 425/186 |
| 4,479,767 | 10/1984 | Mared et al. | 425/186 |

FOREIGN PATENT DOCUMENTS

| | | | |
|---|---|---|---|
| 8706056.6 | 9/1987 | Fed. Rep. of Germany . | |
| 530798 | 12/1976 | U.S.S.R. | 425/354 |
| 1144952 | 3/1969 | United Kingdom . | |
| 1438406 | 6/1976 | United Kingdom | 425/353 |
| 2092508A | 8/1982 | United Kingdom . | |

*Primary Examiner*—Jay H. Woo
*Assistant Examiner*—James P. Mackey
*Attorney, Agent, or Firm*—Frishauf, Holtz, Goodman & Woodward

[57] ABSTRACT

A tablet making machine of the kind including a rotor having a die table carrying dies and opposed pairs of punches which operate in the dies, under the control of fixed position cams to form tablets in the dies is described. The rotor is carried by bearings mounted on an intermediate axially extending portion of a spindle fixed on the machine frame at its opposite ends. The rotor is made removable from the machine together with the intermediate spindle portion and the rotor bearings for replacement by a separately serviced rotor. In this fashion, downtime is reduced for tool and product changeover.

4 Claims, 5 Drawing Sheets

TABLET MAKING MACHINES

BACKGROUND OF THE INVENTION

The present invention relates to a tablet making machine comprising a frame, a spindle mounted on the frame and fixed to the frame at opposite ends and a rotor carried by bearings mounted on an intermediate axially extending portion of the spindle, the rotor including a die table carrying dies and opposed pairs of punches, one pair for each die guided in punch guides of the rotor, the positions of the punches being controlled by fixed cam means carried from the frame.

With such a machine any "run-out", i.e. wobble of the rotor is fully controlled, to a minimum, to improve the consistency of the die fill and hence the tablet weight consistency.

Certain proposals have already been made for reducing downtime for tool and product changeover on rotary tablet presses. In one such proposal, described in German Petty Patent No. 87 06 056.6 the press has a rotor located in a housing and connected to a drive shaft, the rotor including a die table and means in which top and bottom punches are guided, the position of which is controlled as the rotor rotates by fixed cams mounted on holders. The holders are connected to fixed parts of the machine housing by detachable connectors and coupled by freely running couplings, to the rotor, these couplings coming into play when the rotor is lifted from the drive shaft, after the connectors for the holders have been detached, to connect the cams and holders to the rotor for removal with the rotor from the press. The machine in this case is a spindleless machine, the rotor being cantilevered on the drive shaft bearings.

SUMMARY OF THE INVENTION

The present invention aims to provide significant improvements in downtime for spindled presses.

This is achieved in accordance with the present invention in that, proceeding from a machine as defined in the opening paragraph of this specification, the intermediate, axially extending portion of the spindle is formed as a separate portion of the spindle which is normally fixed in position by releasable means which, when released, allows the intermediate portion of the spindle to be removed transversely from the machine, together with the rotor and the rotor bearings.

In a preferred development, in accordance with the present invention, said intermediate, axially extending portion of the spindle is axially clamped in its normally fixed position and supports a fixed frame member which carries the cam means for controlling corresponding ones of the punches of each pair, said fixed frame member being removable with said intermediate axially extending portion of the spindle This feature permits, e.g. the cam means controlling the top punches, to be removed from the machine directly with the rotor, without any need to unfasten any further, individual fastenings.

It is also preferred that said intermediate, axially extending portion of the spindle is axially clamped in its fixed position between opposite end portions of the spindle carried by the frame.

By this means, the intermediate spindle portion may be readily unclamped, e.g. from one end, for removal from the machine.

The rotor may be driven by drive dogs on a drive pulley rotatably mounted on one of said fixed end portions of said spindle, the drive dogs engaging drive dogs on the pulley, and the other fixed end portion of the spindle may be axially displaceable by fluid pressure to clamp the intermediate, axially extending portion of the spindle against said one fixed end portion of said spindle.

With this arrangement, the inter-engaging drive dogs are freed of the clamp-up loads.

Conveniently, the drive dogs are engageable and disengageable axially of the spindle and said one fixed end portion of said spindle incorporates a jack means operable to lift said intermediate axially extending portion of the spindle to disengage the drive dogs and position the intermediate portion for transverse removal from the machine.

These and other advantageous features of the present invention will become clear from the following detailed description, given by way of example, with reference to the accompanying figures of drawings which show one specific embodiment.

DESCRIPTION OF THE PREFERRED EMBODIMENT

Figure 1:
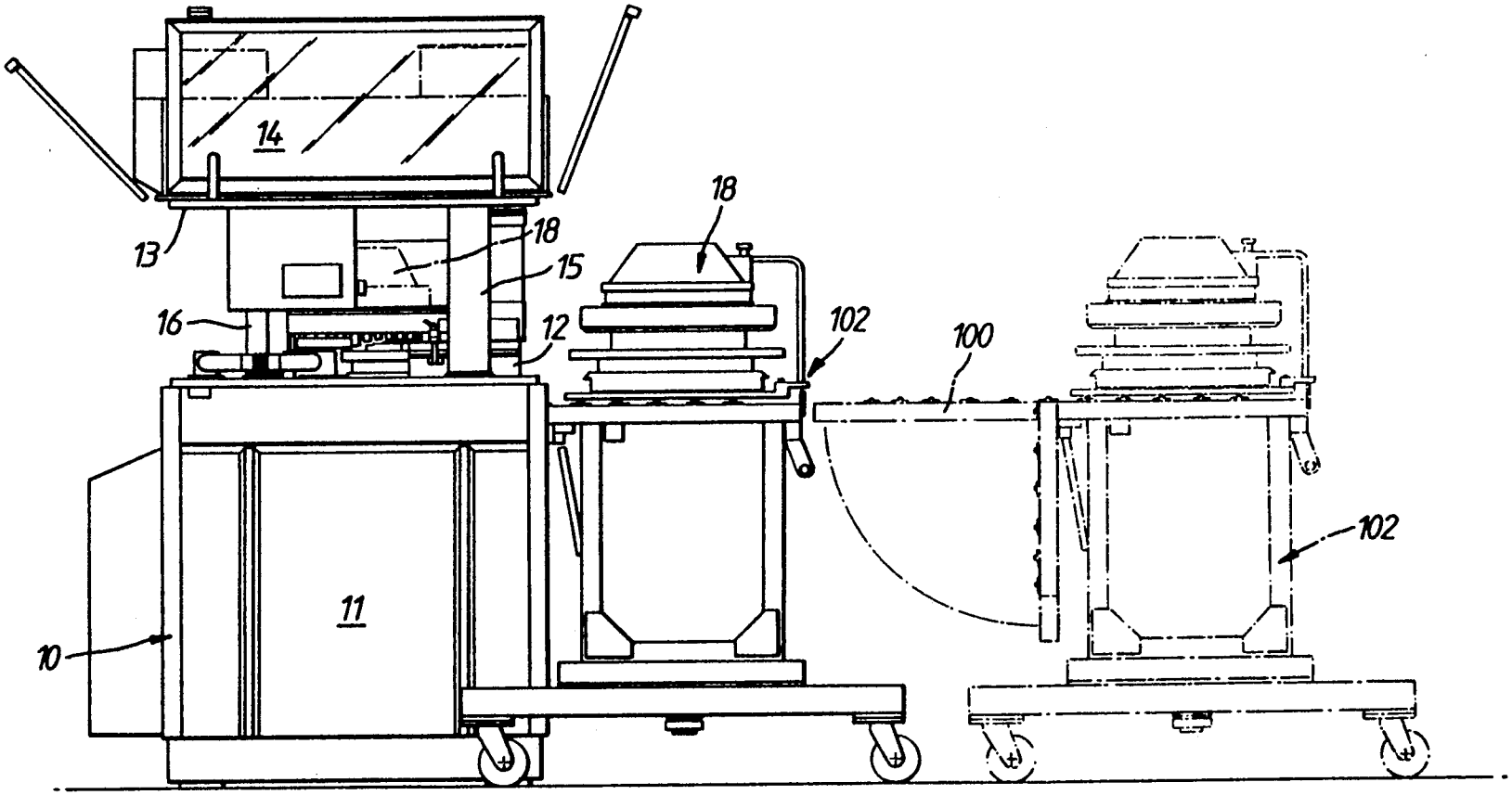
FIG. 1 is a side view of a tablet making machine in accordance with the present invention and showing centrally a trolley in a rotor removing position and bearing the machine rotor carried by an intermediate axially extending portion of the spindle, which has been transversely removed from the machine, together with the cams and cam holders, on a conveyor roller belt of the trolley, the original tablet making position of the rotor in the machine being shown in chain dotted outline, and the trolley also being shown in chain dotted outline in a removed position carrying away the rotor for servicing.

With reference now to the figures of drawing and first to FIG. 1, the machine comprises a base frame 10 comprising a cabinet 11 having a cabinet top 12 and an upper frame 13 comprising a cabinet 14 supported from the lower frame on pillars, there being two front pillars 15 disposed one to each side of the cabinet top 12 towards the front and two rear pillars 16 disposed more centrally than the front pillars 15 towards the back of the cabinet top 12. The positions of the pillars 15 and 16 are most clearly seen in the cross-sectional view of FIG. 4.

The machine has a rotor 18 arranged to be driven by a drive pulley 19 through inter-engaging drive dogs 20, 22. The pulley 19 is arranged to be driven from a drive shaft 24 by a drive belt 26.

The drive pulley 19 is carried by bearings 28, 30 mounted on a lower, fixed end portion **32*a* of a spindle 32 attached to the machine base frame 10. An upper, end portion 32*c* of the spindle 32** is attached to the machine upper frame 13. The portion 32c of the spindle comprises a fluid operable clamp-up member 34 which is displaceable axially of the spindle by fluid under pressure supplied to a cylinder space 36 to urge the member 34 downwardly in the drawings into engagement with the upper end face 38 of an intermediate, axially extending portion 32b of the spindle 32 thereby to clamp the lower end face 40 of the portion 32b of the spindle against the upper end face 42 of the spindle portion 32a.

Figure 3:
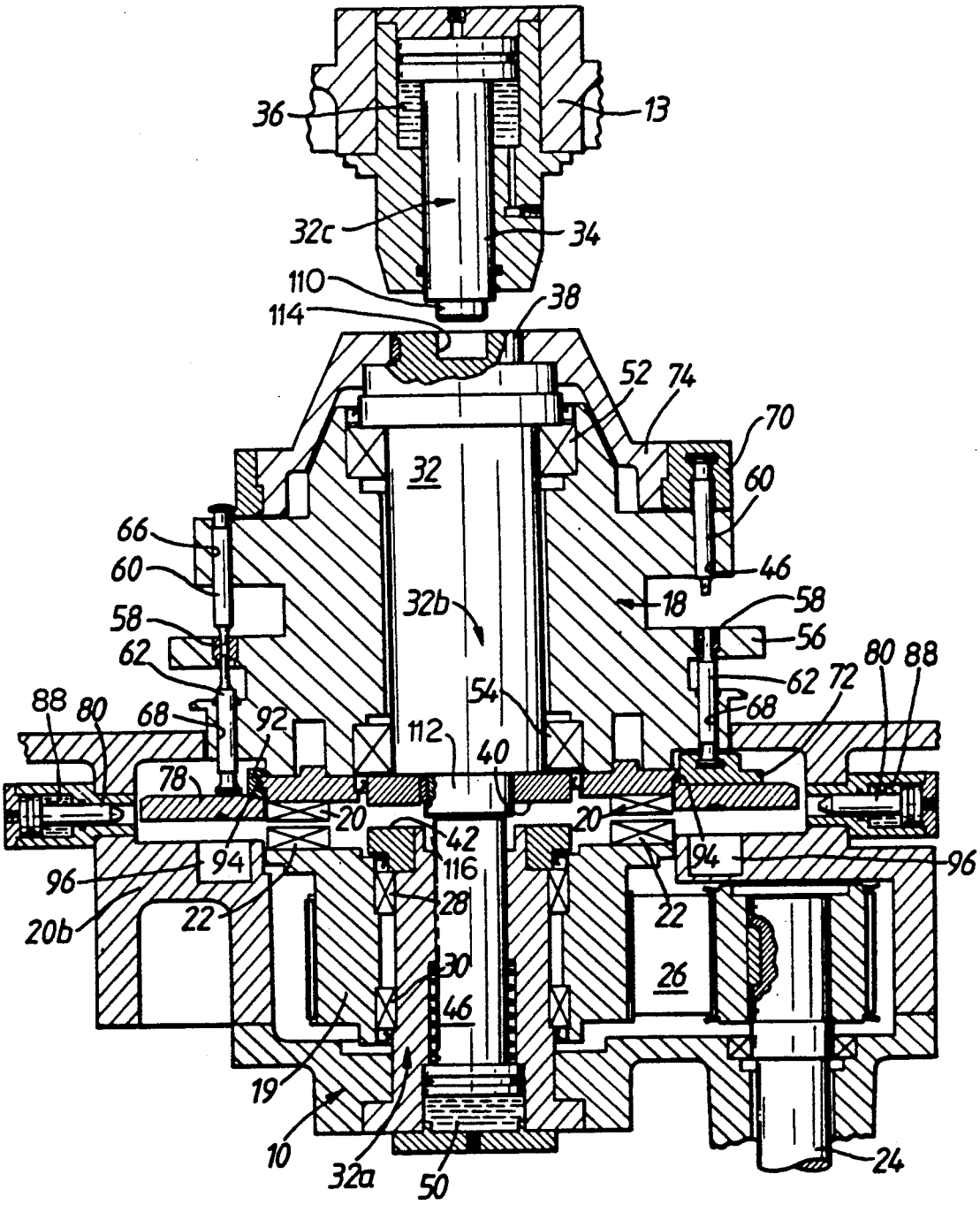
FIG. 3 is a corresponding view showing the intermediate, axially extending portion of the spindle lifted by the jack means ready for transverse removal of the rotor and the cams and cam holders from the machine on the trolley conveyor.

The member 34 is reversely displaceable by the supply of fluid under pressure to a cylinder space 44 to unclamp the mid-spindle portion 32b and the spindle portion 32a incorporates a fluid operable jack 46 which may be raised by the supply of fluid under pressure to a cylinder space 50 to lift the mid-spindle portion 32b to the position shown in FIG. 3, in which the drive dogs 20, 22 are disengaged The mid-spindle portion 32b mounts rotor bearings 52, 54 which carry the rotor 18. The rotor 18 comprises a die table 56 carrying dies 58 and opposed pairs of punches 60, 62 one pair for each die. The punches 60, 62 are guided in punch guides 66, 68 of the rotor, the positions of the punches 60, 62 being controlled by respective upper and lower fixed cams 70, 72.

Figure 2:
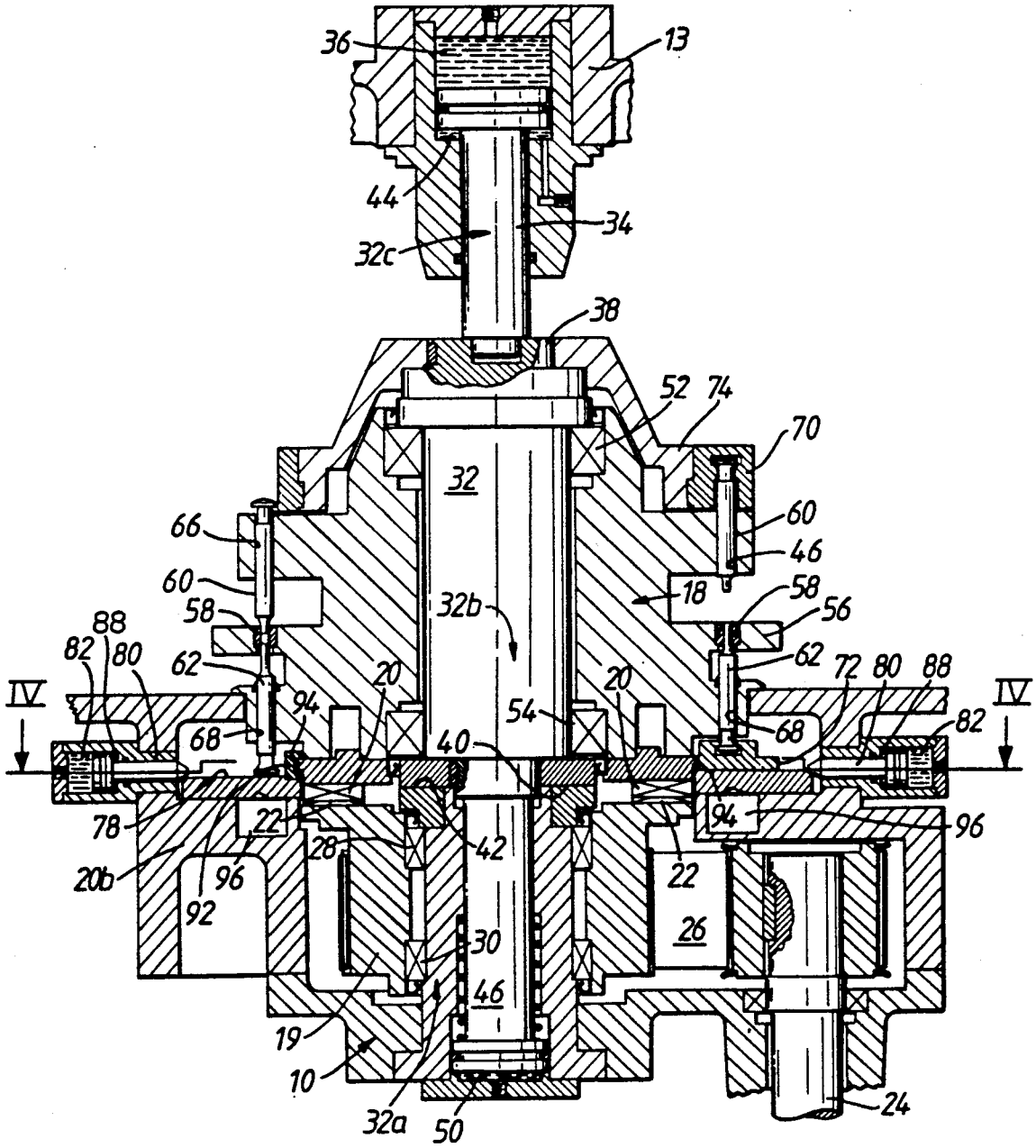
FIG. 2 is a vertical cross-section of a relevant portion of the tablet-making machine of FIG. 1 in its assembled tablet making condition.
Figure 4:
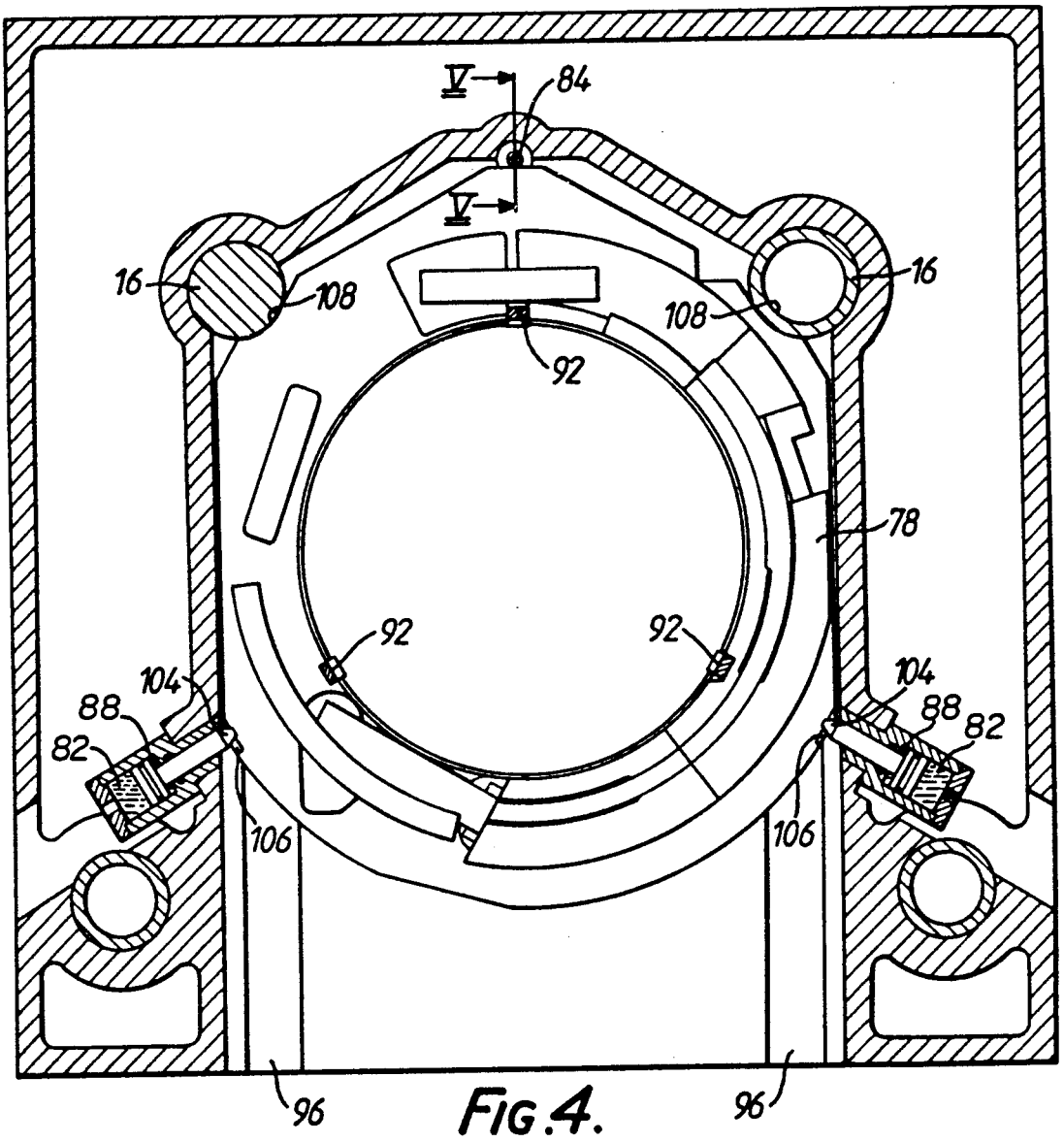
FIG. 4 is a horizontal section on line 4—4 in FIG. 1.
Figure 5:
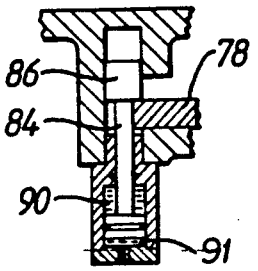
FIG. 5 is a vertical section on line 5—5 in FIG. 4.

The upper cam 70 is carried by a support 74 fixed to the upper end of the mid-spindle portion 32b and the lower cams are carried by a cam plate 78 which is fixedly clamped to the cabinet top 12 of the machine base frame 10 by two front fluid pressure extendible pins 80 extendible radially inwardly by the supply of fluid under pressure to cylinder spaces 82 to positions as shown in FIGS. 2 and 4 and by one rear fluid pressure clamp down pin 84 having a head 86 to engage with its underside against the top of the cam plate 78 when fluid under pressure is supplied to cylinder space 90 (see FIG. 5).

On unclamping of the cam plate 78 by retraction of the pins 80 to positions as shown in FIG. 3 by the supply of fluid under pressure to the cylinder spaces 88, and on raising of the pin head 86 by the supply of fluid under pressure to the cylinder space 91 seen in FIG. 5, the cam plate 78 is released to be raised by cam plate support blocks 92 which normally maintain a running clearance with a rotor flange 94 but which engage with the flange 94 to cause the cam plate 78 to be lifted with the rotor 18 when the mid-spindle portion 32b carrying the rotor is lifted by the jack 46.

In this lifted position, as seen in FIG. 3, the rotor 18 is freed to be removed transversely from the machine, complete with the mid-spindle portion 32b and the rotor bearings 52, 54, the upper cam support 74 and the upper cam 70, the cam plate 78 and all the punches 60, 62.

To assist in this operation trolley fork passages 96 are provided in the cabinet top 12 for trolley forks 100 of trolley 102 (see FIG. 1) to engage beneath the cam plate 78 to support the rotor 18 so that it can be wheeled by the trolley, out of the machine.

A fully serviced replacement rotor 18 may then immediately be wheeled into position on a further trolley 102 and lowered into drive engagement in the machine by lowering of the jack 46, the clamp-up member 32c next being operated to clamp the rotor 18 in its tablet making position, at the same time refixing the upper cam support 74 and cam 70. Additionally, the clamp pins 80, 84 are operated to clamp the lower cam plate 78 fixedly to the cabinet top 12, this re-establishing the machine in its operational mode.

As seen in FIG. 4, the replacement cam plate 78 is positioned against the rear pillars 16, when the replacement rotor is wheeled into position on the trolley 102 and then centred by extension of the pins 80, which have tapered ends 104 to engage chamfers 106 on the upper edge of the cam plate 78, the cam plate having cut outs 108 to engage the pillars 16, the pin head 86 being lowered to prevent any tilting of the cam plate. The upper end portion 32c and the mid-spindle portion 32b of the spindle have guide bosses 110 and 112 at their lower ends respectively which enter recesses 114, 116 in the upper ends respectively of the mid-spindle portion 32b and the lower end portion 32a of the spindle, thereby to centre the mid-spindle portion 32b with respect to its end portions upon reinstatement of a rotor 18.

In an alternative arrangement, the clamp-up member 32c may engage the upper cam support if desired, the upper cam support 74 covering over the upper end of the mid-spindle portion 32b.

The hydraulic system of the machine enabling rotor 18 removal and replacement will next be described with reference to FIG. 6. The hydraulic system comprises a hydraulic pump 120 connected to be driven by an electric motor 121 to draw fluid from a fluid reservoir 122 and supply the fluid under pressure to a conduit 124. When the line pressure reaches a preset value, determined by the setting of a pressure relief valve 126, a two-position solenoid valve 128 is operated to move to its second position against the action of its spring 130, thereby to initiate the retraction of the clamp pins 80 and the raising of the clamp pin head 86. Hydraulic fluid flows into a conduit 132 and opens a check valve 134. The pressure fluid then flows via a non-return valve 135 and a conduit 136, and also via conduits 138 and 140, into the cylinder spaces 91 and 88 already described. At the same time, hydraulic fluid is exhausted from the cylinder spaces 90 and 82 and flows via a conduit 142, the check valve 134, the solenoid valve 128 and conduit 144 back into the fluid reservoir 122.

A two-position solenoid valve 146 is next operated to move to its second position against the action of its spring 148 to select a light fluid-pressure-holding of the clamp-up member 34 to hold the rotor 18 steady during its subsequent lifting operation by the jack 46. A two-position solenoid valve 150 is moved against the action of its spring 152 to its second position. A three position solenoid valve 154 remains in its second position as shown in FIG. 6. A three position solenoid valve 158 is adjusted upwardly in FIG. 6 to its third position. Fluid under pressure flows via a conduit 160 and non-return valve 162 into the cylinder space 50 to raise the jack 46, thus forcing hydraulic fluid out of the cylinder space 36 via a conduit 162, the solenoid valve 150, a pressure relief valve 164, the solenoid valve 146 and line 144, back to the hydraulic fluid reservoir 122.

The rotor 18 is now in its raised position shown in FIG. 3. Solenoid valve 158 is returned to its second, i.e. central, position, as illustrated in FIG. 6. This locks the jack 46 in its raised position.

A sensor (not shown) is provided to indicate that the trolley 102 is in position with its forks 100 engaged beneath the cam plate 78.

Figure 6:
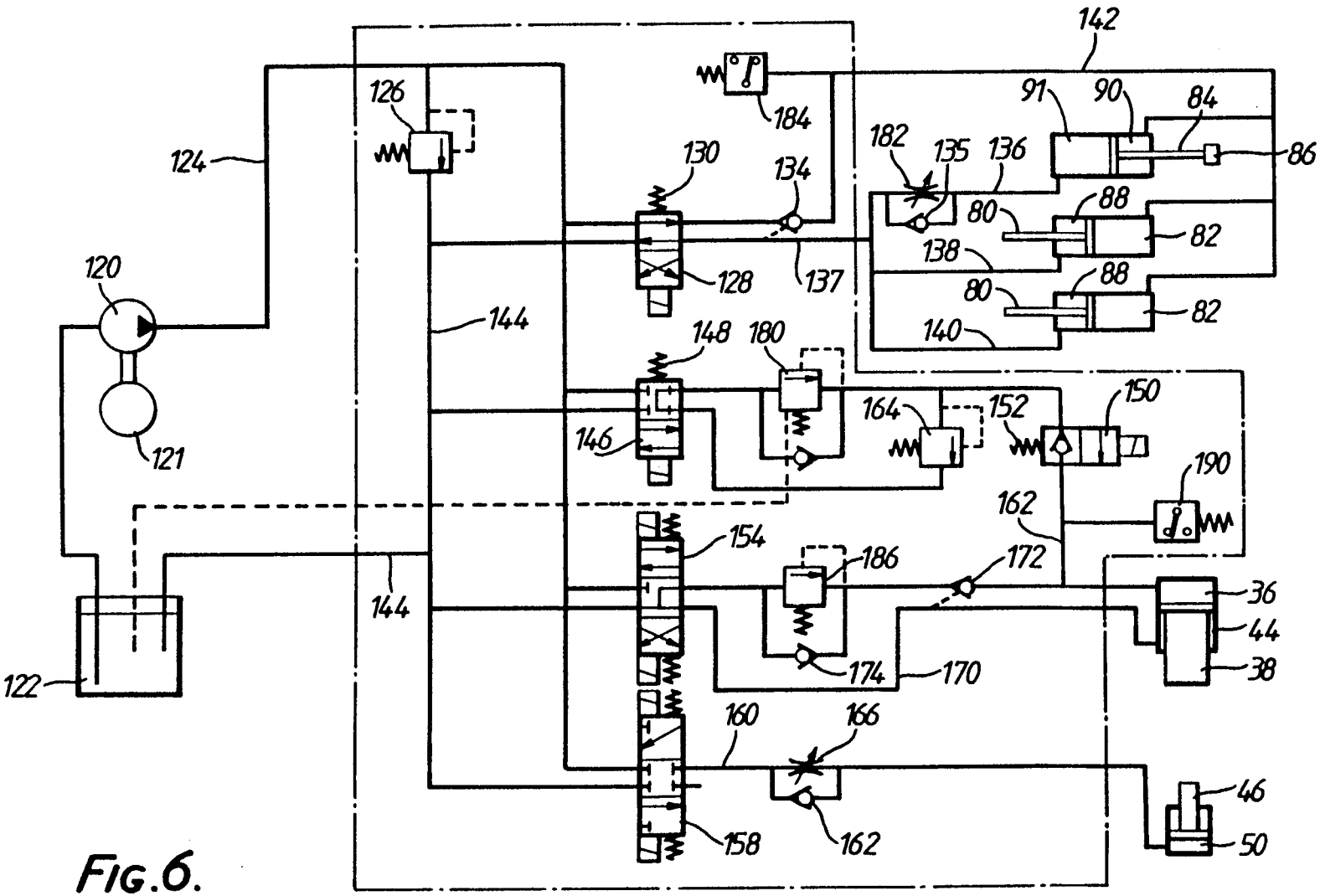
FIG. 6 is a hydraulic circuit diagram.

Solenoid valve 158 is adjusted to its first position, i.e. downwardly, in FIG. 6. The weight of the rotor 18 then forces hydraulic fluid out of the cylinder space 50 via a fluid flow restrictor 166, the conduit 160, the solenoid valve 158, and the conduit 144 back to the hydraulic fluid reservoir 122. At the same time, the solenoid valve 154 is adjusted upwardly in FIG. 6, into its third position. Hydraulic fluid flows via a conduit 170 into the cylinder space 44. The pressure of fluid in the conduit 170 opens a check valve 172 and hydraulic fluid is forced out of the cylinder space 36 via the valve 172, a non-return valve 174, the solenoid valve 154 and the conduit 144 into the reservoir 122. The clamp-up member is thus fully raised to release the rotor 18 for transverse removal from the machine.

In order to replace a serviced rotor 18, the rotor is wheeled into position on the trolley 102. The sensor 160 detects that the rotor is in place. The motor 121 is started. Solenoid valve 146 and solenoid valve 150 are moved to their second positions to select light fluid-pressure-holding of the rotor. Hydraulic fluid under pressure flows via a pressure reducing valve 180 and the solenoid valve 150 into the cylinder space 36 to lower the clamp-up member 34 to enter its bos 110 into the recess 114 of the rotor and steady the rotor in its trolley supported position. After a time interval, solenoid valve 158 is adjusted to its third position and hydraulic fluid flows via the conduit 160 and non-return valve 162 into the cylinder space 50, thereby jacking up the rotor on the jack 46. Hydraulic fluid is forced out of the cylinder space 36 via the solenoid valve 150, pressure reducing valve 164, solenoid valve 146 and conduit 144, back into the reservoir 122. Solenoid valve 158 moves to its second position to lock the jack 46 in its raised position. The trolley 102 is then removed. Next, solenoid valve 158 is adjusted into its first position, thus releasing hydraulic fluid from the cylinder space 50 for return to the reservoir 122. The jack 46 is lowered under the weight of the rotor. Solenoid valve 128 is moved to its first position and hydraulic fluid flows via the check valve 134 and conduit 142 into the cylinder spaces 90 and 82 to lower the clamp pin head 86 and extend the clamp pins 80 into their clamping positions in which they clamp the cam plate 78 to the cabinet top 12. Hydraulic fluid returns from the cylinder spaces 91 and 88 via the conduit 137 and solenoid valve 128 to the reservoir 122. The hydraulic fluid from the cylinder space 91 flows via the flow restrictor 132 to reduce the speed at which the clamp pin head 186 is engaged. A pressure switch 184 changes over when the pressure in the conduit 142 reaches a predetermined value so as to signal when the cam plate 78 has been clamped in position by the clamp pins 80 and the clamp pin head 82. Solenoid valve 154 is next to its first position to allow pressure fluid to flow via the pressure reducing valve 186 and the check valve 172 into the cylinder space 36 to increase the holding force of the clamp-up member 34. The pressure in the cylinder space 36 is sensed by the pressure switch 190 which changes over to signal when the pressure reaches a predetermined higher value at which the rotor is firmly clamped in place for tablet manufacturing. Solenoid valve 128 is then returned to its second position to maintain the pressure in the turret clamp cylinder 36 at the higher value, whilst allowing the motor 121 to be switched off and the hydraulic pump 120 stopped until rotor removal and replacement is again required.

Although the present invention has been described with reference to a preferred embodiment, modifications may be made by those skilled in the art without departing from the scope and spirit of the present invention as defined by the appended claims.

I claim:

1. In a tablet making machine comprising a frame including a frame proper and a fixed spindle for a rotor mounted on the frame, the fixed rotor spindle being fixed to the frame proper at its opposite ends, a rotor carried by bearings mounted on an intermediate axially extending portion of the spindle, the rotor including a die table carrying dies and opposed pairs of punches, one pair for each die, guided in punch guides of the rotor, the positions of the punches being controlled by first and second fixed cam means carried by the frame, said first fixed cam means controlling one set of corresponding punches of each pair and said second fixed cam means controlling the other set of corresponding punches of each pair, the improvement in that the intermediate, axially extending portion of the spindle is a separate portion of the spindle, which is normally fixed in position between fixed opposite end portions of the spindle by releasable means which, when released, allows the intermediate portion of the spindle to be removed transversely from the machine, together with the rotor and the rotor bearings.

2. A machine as claimed in claim 1, wherein said intermediate, axially extending portion of the spindle is axially clamped between said fixed opposite end portions of the spindle in its normally fixed position and supports a fixed member constituting a further element of said frame, said fixed frame member carrying the fixed cam means for controlling one of said sets of corresponding punches of each pair, said fixed frame member being removable with said intermediate axially extending portion of the spindle.

3. A machine as claimed in claim 1, wherein the rotor is driven by drive dogs on a drive pulley rotatably mounted on one of said fixed opposite end portions of said spindle, the drive dogs engaging drive dogs on the rotor, and the other of said fixed opposite end portions of the spindle is axially displaceable by fluid pressure to clamp the intermediate, axially extending portion of the spindle against said one of the fixed opposite end portions of said spindle.

4. A machine as claimed in claim 3, wherein the drive dogs are engageable and disengageable axially of the spindle and a jack means is provided having an extendable and retractable member housed in said one of the fixed opposite end portions of said spindle and operable to lift said intermediate axially extending portion of the spindle to disengage the drive dogs and position the intermediate portion for transverse removal from the machine.

* * * * *